United States Patent [19]

Vallevand

[11] 4,366,731

[45] Jan. 4, 1983

[54] SOCKET WRENCH

[76] Inventor: Shawn T. Vallevand, Box 133, Elbow, Saskatchewan, Canada, SOH 1JO

[21] Appl. No.: 221,997

[22] Filed: Jan. 2, 1981

[30] Foreign Application Priority Data

Sep. 30, 1980 [CA] Canada ..... 361466

[51] Int. Cl.[3] ..... B25B 17/00

[52] U.S. Cl. ..... 81/57.3; 81/57.31

[58] Field of Search ..... 81/57.31, 57.39, 57.3; 173/163; 74/88, 812

[56] References Cited

U.S. PATENT DOCUMENTS 1,860,914 5/1932 Wellman ..... 81/57.31
2,641,136 6/1953 Marsden ..... 81/57.31
3,828,629 8/1974 Moore ..... 81/57.3
3,983,759 10/1976 Linden ..... 81/57.3

*Primary Examiner*—Jimmy C. Peters
*Attorney, Agent, or Firm*—Berman, Aisenberg & Platt

[57] ABSTRACT

There is provided a novel drive unit for a socket-type wrench which leads to increased speed of turning of the sockets. The unit comprises a casing; a first ratchet mechanism in said casing; a second ratchet mechanism in said casing; apparatus for selectively transmitting power from said second mechanism to said first mechanism whereby when said first mechanism is in a ratcheting mode, said second mechanism may be selected to transmit power through said first mechanism to a workpiece.

15 Claims, 2 Drawing Figures

SOCKET WRENCH

This application relates to a socket wrench and in particular to such a wrench having a higher than normal speed capability.

BACKGROUND OF THE INVENTION

The present invention arises in the context of the continuing search for more efficient tools which will result in time savings to complete given jobs with consequent economic benefits. In particular, with regard to conventional socket wrenches, such wrenches, while useful in many situations, are somewhat limited in speed of operation. This results from the wasted return ratchetting stroke required with each turn of the wrench. It is to be the effective utilization of this return stroke that the present invention is directed.

PRIOR ART

Various wrenches are known in the art the object of which is to increase the speed at which a nut or bolt can be turned. These take various forms incorporating unique designs of operating heads, handles and gearing. None are known to the present applicant which incorporate two separate ratchet mechanisms interrelated by a power transmitting means. Applicant is therefore unable to specify any specific pieces of prior art which bear similarity to the present invention.

SUMMARY OF THE INVENTION

The present invention involves a novel approach to the problem of increasing the speed at which a nut or bolt can be turned using a socket wrench. The use of dual ratchet mechanisms together with means for transmitting power from both of them to a socket drive enables the drive to be operated not only on the conventional power stroke but also on the return stroke of the wrench handle as well. As a result the operating speed of the wrench can be at least doubled.

Accordingly, the invention provides a socket wrench drive tool comprising a casing; a first ratchet mechanism in said casing; a second ratchet mechanism in said casing; means for selectively transmitting power from said second mechanism to said first mechanism whereby when said first mechanism is in a ratchetting mode, said second mechanism may be selected to transmit power through said first mechanism to a workpiece.

BRIEF DESCRIPTION OF THE DRAWINGS

In drawings which illustrate embodiments of the invention.

DETAILED DESCRIPTION OF THE PREFERRED EMBODIMENTS

Figure 2:
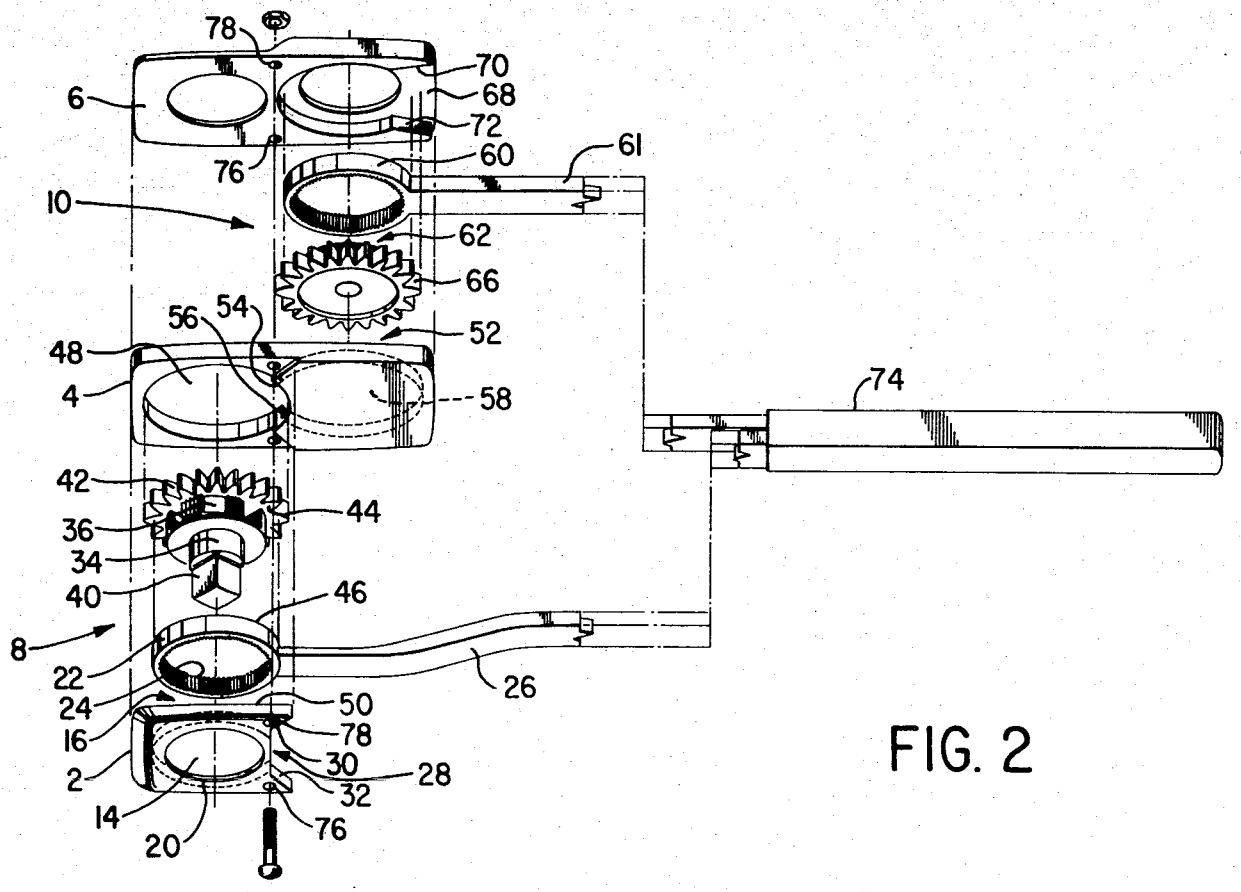
FIG. 2 is an exploded perspective view of the embodiment of FIG. 1.
Figure 1:
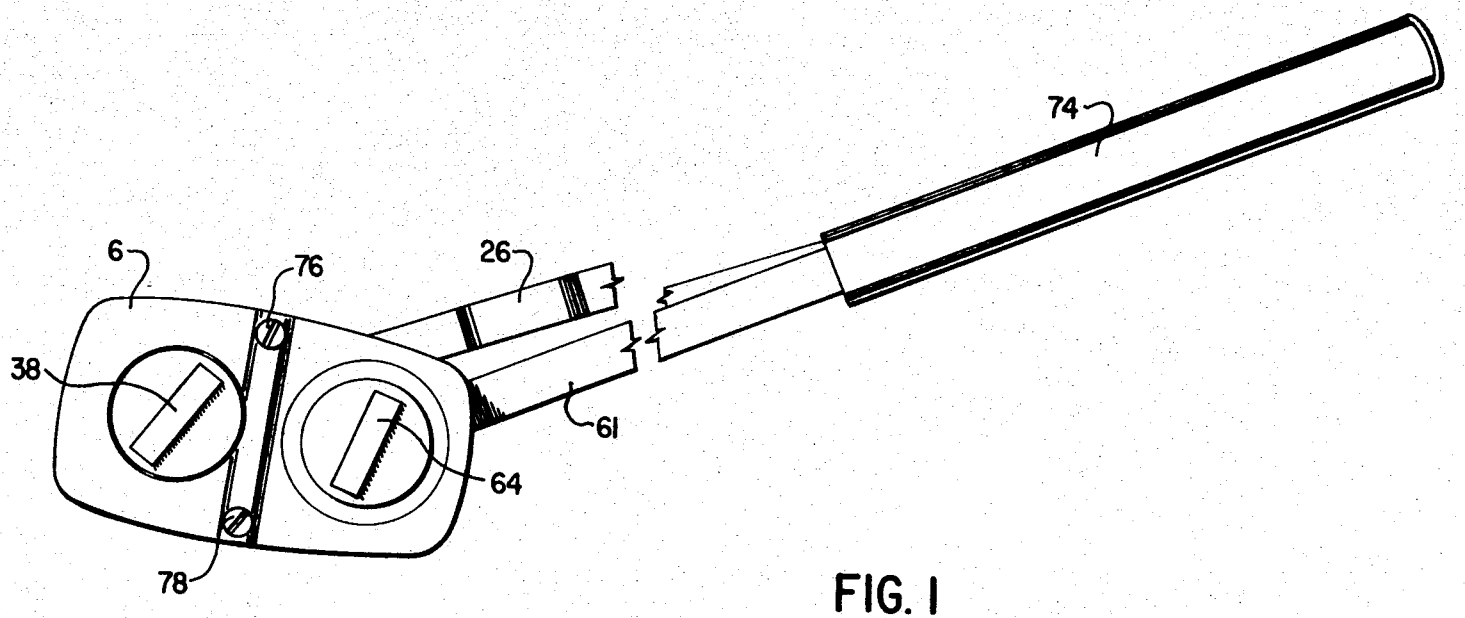
FIG. 1 is a top plan view of one embodiment of the invention.

While the invention will be described in connection with a preferred embodiment, it will be understood that it is not intended to limit the invention to such embodiments. On the contrary, it is intended to cover all alternatives, modifications and equivalents as may be included within the spirit and scope of the invention as defined by the appended claims.

In the following description, similar features are identified with identical reference numerals.

With reference to the drawings the casing comprises a lower cover plate 2, a middle section 4 and a top section 6. The ratchet mechanisms 8 and 10 are seated within the casing. In the preferred embodiment these two mechanisms are laterally offset. Further, the mechanisms are preferably also vertically offset from each other.

The mechanism 8 includes a conventional reversible ratchet arrangement as is known in the art. Thus the lower cover plate 2 contains a cylindrical cavity 14 which is open at the top 16 and partially closed at the bottom by the integral support ring 20. The ratchet wheel 22 having interior teeth 24 is seated on support ring 20 in cavity 14. Handle 26 is attached to ratchet wheel 22 and extends through the opening 28 in the wall of cavity 14. The opening is defined by the edges 30 and 32 and these limit the rotation of the ratchet wheel 22 relative to the cavity 14.

The carrier 34 carries the reversible pawl 36 and the flipper 38 which control the action of the pawl 36 by a conventional mechanism internally of the carrier 34. The carrier 34 also carries attached to the bottom thereof the socket drive shaft 40.

The mechanism 8 differs from the conventional ratchet mechanism in that the carrier also carries a gear wheel 42 attached above the pawl 36 and below flipper 38. The lower surface 44 of gear wheel 42 bears on upper surface 46 of ratchet wheel 22.

By this mechanism the shaft 40 can be controlled in the conventional manner. With the addition of the second ratchet mechanism 10, however, the tool gains considerable versatility.

The middle part 4 of the casing includes the cylindrical chamber 48 which fits over gear wheel 42 and is secured against the top surface 50 of lower section 2 of the casing. The gear wheel 42 is thereby laterally secured.

Middle part 4 of the casing contains cylindrical cavity 52 which overlaps with the cylindrical chamber 48 between the lines of intersection 54 and 56. Bottom 58 of cavity 52 is closed and forms a support for the second ratchet mechanism 10.

With two exceptions the mechanism 10 is similar to mechanism 8. Thus, while the mechanism is shown as a closed unit, it includes the ratchet wheel 60 having internal teeth and the associated handle 61; the carrier 62 carrying flipper 64 and its associated reversible pawl; and the gear wheel 66 attached to the bottom of carrier 62. This mechanism differs from mechanism 8 in the absence of a socket drive shaft and in the attachment of gear wheel 66 below rather than above the ratchet wheel.

The gear wheel 66 of mechanism 10 is seated within the cavity 52. As will now be evident, the gear wheels 42 and 66 are in operative relationship by reason of the overlapping of chamber 48 and cavity 52.

The top section 6 of the casing is now secured over the tops of the mechanisms 8 and 10 to hold the whole together. An opening 68 is provided through the end of section 6 to accommodate the handle 61. The opening is defined by the edges 70 and 72 and these limit the rotation of the ratchet wheel 60 relative to the cavity 52.

The handles 26 and 61 are required to be free moving within limits relative to each other, as will be explained below. At the same time the full advantage of the invention is obtained by moving the handles as a unit. A cover unit 74 is therefore preferably provided over the ends of the handles to provide a convenient single hand grip and allow the necessary freedom of movement. The cover 74 can conveniently be secured to the handle 61.

In the embodiment illustrated the casing is comprised of the three sections 2, 4 and 6 which are bolted together at 76 and 78. However, any such casing would be suitable which maintains the parts in the necessary positions.

The arrangement just described provides several modes of operation for the wrench depending on the setting of the pawls and the manipulation of the wrench itself.

There are basically two combinations of settings for the pawls. Either both pawls are set to engage in the same direction of rotation of the ratchet wheels, or they are set to engage in opposite directions.

If the pawls are set to engage in opposite directions of rotation of the ratchet wheels, three possible modes of operation result. First, the wrench will operate as a conventional reversible ratchet wrench when the handles are gripped as by the cover 74 and rotated about the workpiece. In this mode power will be transmitted in one direction of rotation and the wrench will ratchet back on the return stroke.

The first ratchet mechanism 8 will be operating conventionally in this situation and the second ratchet mechanism 10 will be passive, since there will be no relative movement of ratchet wheel 60 about its axis. The only movement in mechanism 10 will be that of the gear wheel and carrier ratchetting on the ratchet wheel 60 because of the operative relationship of the two gear wheels. There is simply no power stroke in the mechanism 10 at this point.

Second, the high speed feature of the invention will operate when the casing is gripped and held immobile with one hand such that both the upper handle 26 and lower handle 61 will rotate their associated ratchet wheels about their respective axes. Effectively what is happening is that the first mechanism 8 is continuing to operate as in the first mode described above, while the second mechanism 10 is now, by reason of the rotation of ratchet wheel 60, also operating conventionally. Because the pawls are set to engage in opposite directions, the two mechanisms will provide power strokes in opposite directions. The gear wheels will then reverse the direction of rotation of the power stroke of the second mechanism so that the shaft 40 will be rotated in the same direction for both strokes of the combined handle. Thus, for a 1:1 gear ratio in the gear wheels, the shaft 40 will be turned at twice the rate of a conventional ratchet wrench.

The relative speed increase achieved over a conventional wrench can be varied by a variation of the gear ratio between the gear wheels.

The third mode of operation utilizable when the pawls are engaged in opposite directions is advantageous where the work space is small. This mode is essentially the same as the second mode described just above with the following difference. Instead of holding the casing immobile and rotating the handles, the handles are held steady by gripping the cover 74, and the casing is then rotated back and forth about the first mechanism with the other hand. This achieves the same effect as the second mode but with less space required.

In both of the second and third modes the lower handle 61 moves in an arc relative to the upper handle 26 and for that reason cover 74 must be such as to allow that relative movement.

With both of the high speed modes, the torque which can be applied through the second mechanism 10 is limited by the strength of the individual gripping the casing. As the torque opposing shaft 40 increases, it will eventually overcome that applied to the casing by the operator's hand. For this reason the high speed function is used to best advantage to snug up a workpiece having a relatively long thread. The conventional mode can then be employed to tighten down the last few turns, as required.

For all of the above modes, the direction of rotation of shaft 40 can be reversed by reversing both pawls.

If the pawls are now set to engage in the same direction, the result will be the locking of the mechanisms. The final mode of operation is thus a locked one with no ratchetting operation in either direction.

It will be noted that the angle of rotation of the handles is limited by the edges 30 and 32, and 70 and 72, of the openings 28 and 68 respectively. This angle of permitted rotation is a design consideration and can be varied as desired within the constraints inherent to the device.

Thus it is apparent that there has been provided in accordance with the invention a socket wrench that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A socket drive tool comprising:

a casing;

first and second ratchet mechanisms in said casing, said mechanisms having parallel axes and being offset from each other; and means for selectively transmitting power from said second mechanism to said first mechanism whereby when said first mechanism is in a ratchetting mode, said second mechanism may be selected to transmit power through said first mechanism to a workpiece, said means for transmitting power comprising a gear train consisting of first and second gear wheels, one of said wheels associated with said first mechanism and the second of said wheels associated with said second mechanism, said gear wheels meshing in operative relationship.

2. The tool of claim 1 wherein said first and second mechanisms each comprise a pawl, a carrier for said pawl, an engaging and disengaging means for said pawl, a ratchet wheel, and a handle attached to said wheel; and wherein said first gear wheel is attached to one of said carriers and said second gear wheel is attached to the other of said carriers.

3. The tool of claim 2 wherein the ends of said handles remote from said mechanisms are associated whereby the said handles can be moved as a unit.

4. The tool of claim 3 wherein said handles are moveable through limited arcs and the said arcs are bisected by the plane through the axes of the ratchet mechanisms.

5. The tool of claim 4 wherein said arcs are on the side of said tool remote from said first mechanism.

6. The tool of claim 5 wherein each said ratchet mechanism is reversible.

7. The tool of claim 1 wherein each said ratchet mechanism is reversible.

8. The tool of claim 2 wherein the gear ratio between said gear wheels is 1:1.

9. The tool of claim 3 wherein a section of the said handles toward the ends thereof remote from said mechanisms is encased in a cover, which cover allows limited relative movement in all lateral directions between said ends.

10. The tool of claim 4 wherein the said handles are moveable through a minimum arc of 60 degrees.

11. The tool of claim 2 wherein said first and second mechanisms are vertically offset and wherein in said first mechanism the gear wheel is attached to the top part of the associated carrier and in said second mechanism the gear wheel is attached to the bottom part of the associated carrier.

12. A socket drive tool comprising:

a casing;

first and second ratchet mechanisms in said casing, each including a pawl, a carrier for said pawl, an engaging and disengaging means for said pawl, a ratchet wheel, and a handle attached to said wheel; said mechanisms having parallel axes and being laterally offset from each other; and a gear wheel associated with each said mechanism, said gear wheels meshing in operative relationship;

whereby power may be selectively transmitted from said second mechanism to said first mechanism such that when said first mechanism is in a ratchetting mode, said second mechanism may be selected to transmit power through said first mechanism to a workpiece.

13. The tool of claim 12 wherein the ends of said handles remote from said mechanisms are associated whereby the said handles can be moved as a unit.

14. The tool of claim 13 wherein said handles are moveable through limited arcs and the said arcs are bisected by the plane through the axes of the ratchet mechanisms.

15. The tool of claim 14 wherein each said ratchet mechanism is reversible.

* * * * *